US007785446B2

(12) United States Patent
Makino et al.

(10) Patent No.: US 7,785,446 B2
(45) Date of Patent: Aug. 31, 2010

(54) FLOW SHEET FOR PAPER MACHINE AND METHOD OF MANUFACTURING THE SAME

(75) Inventors: Tetsuo Makino, Mihara (JP); Akimine Izawa, Mihara (JP); Keiichi Fujiki, Mihara (JP); Toshihiro Ito, Otsu (JP); Hiroshi Odani, Iyogun (JP)

(73) Assignee: Toray Industries, Inc., Tokyo (JP)

( * ) Notice: Subject to any disclaimer, the term of this patent is extended or adjusted under 35 U.S.C. 154(b) by 687 days.

(21) Appl. No.: 11/662,364

(22) PCT Filed: Oct. 5, 2004

(86) PCT No.: PCT/JP2004/014651

§ 371 (c)(1),
(2), (4) Date: Jun. 15, 2007

(87) PCT Pub. No.: WO2006/038285

PCT Pub. Date: Apr. 13, 2006

(65) Prior Publication Data

US 2008/0099173 A1 May 1, 2008

(51) Int. Cl.

| | |
|---|---|
| ***D21F 1/06*** | (2006.01) |
| ***D21F 1/02*** | (2006.01) |
| ***B29C 39/10*** | (2006.01) |
| ***B29C 39/24*** | (2006.01) |

(52) U.S. Cl. ..... 162/343; 264/299; 264/DIG. 78

(58) Field of Classification Search ..... 162/336, 162/343, 216; 264/240, 241, 257, 258, 299, 264/DIG. 78

See application file for complete search history.

(56) References Cited

U.S. PATENT DOCUMENTS

| | | | |
|---|---|---|---|
| 4,566,945 | A | 1/1986 | Ewald et al. |
| 4,617,091 | A | 10/1986 | Rodal et al. |
| 4,902,215 | A | 2/1990 | Seemann, III |
| 5,013,406 | A | 5/1991 | Hergert |

(Continued)

FOREIGN PATENT DOCUMENTS

| | | |
|---|---|---|
| CN | 85103870 | 11/1986 |

(Continued)

OTHER PUBLICATIONS

European Search Report dated Jan. 21, 2009 for European Application No. 04792062.4.

(Continued)

*Primary Examiner*—Eric Hug
(74) *Attorney, Agent, or Firm*—Wenderoth, Lind & Ponack, L.L.P.

(57) ABSTRACT

To smooth the surface of a flow sheet that is used in a paper machine and make the flow sheet easy to handle, reinforced fibers are disposed in a mold 5. The entire mold 5 is covered with enclosing members 10, 11 so that an enclosed space 12 is formed inside the enclosing members 10, 11. While air in the enclosed space 12 is being suctioned through one end of the enclosed space 12, matrix resin is supplied to the reinforced fibers through the other end of the enclosed space 12 to impregnate the reinforced fibers with the matrix resin, and the matrix resin is hardened, whereby there is obtained a flow sheet whose surface smoothness is 0.25 μm or less in terms of arithmetical mean roughness.

13 Claims, 7 Drawing Sheets

U.S. PATENT DOCUMENTS

| | | | | |
|---|---|---|---|---|
| 5,545,294 | A | 8/1996 | Linden et al. | |
| 5,645,689 | A | 7/1997 | Ruf et al. | |
| 5,820,734 | A * | 10/1998 | Pantaleo et al. | 162/343 |
| 6,257,858 | B1 | 7/2001 | Pabsch et al. | |
| 2003/0131964 | A1 | 7/2003 | Erikson et al. | |
| 2005/0092453 | A1 | 5/2005 | Erikson et al. | |

FOREIGN PATENT DOCUMENTS

| | | |
|---|---|---|
| EP | 0 711 869 | 5/1996 |
| JP | 60-134093 | 7/1985 |
| JP | 63-50470 | 11/1985 |
| JP | 61-46597 | 3/1986 |
| JP | 8-413 | 2/1996 |
| JP | 11-514050 | 11/1999 |
| JP | 2004-100089 | 4/2004 |
| JP | 2004-308081 | 11/2004 |
| WO | 97/47804 | 12/1997 |
| WO | WO 97/47804 * | 12/1997 |

OTHER PUBLICATIONS

Chinese Office Action dated Jan. 8, 2010 in corresponding Chinese Application No. 200480044159.8 (with English translation).

* cited by examiner

FLOW SHEET FOR PAPER MACHINE AND METHOD OF MANUFACTURING THE SAME

BACKGROUND OF THE INVENTION

I. Technical Field

The present invention relates to a flow sheet that is installed in the headbox of a paper machine to rectify the flow of paper stock within the headbox.

II. Description of the Related Art

When manufacturing paper with a paper machine, to improve the quality of paper to be manufactured, it is necessary to make the quantity of paper stock that is supplied from the headbox to the wire uniform. However, if the paper stock forms considerable turbulence within the headbox, the quantity of paper stock supplied from the headbox cannot be made uniform. Hence, to make the magnitude of a vortex flow of paper stock within the head box smaller, a rectifying sheet called a flow sheet is installed in the headbox.

This flow sheet, as disclosed in Japanese Patent Publication No. SHO 61-46597, is normally disposed within the headbox, with its upstream end fixed and its downstream end floated as a free end in the flow of paper stock. This rectifies the flow of paper stock within the headbox, whereby the quality of paper manufactured by the paper machine is improved. The fluid action and effects that are obtained by the use of the flow sheet within the headbox are described in detail in Japanese Patent Publication No. SHO 61-46597. Japanese Patent Publication No. SHO 61-46597 also discloses that the material of the flow sheet can use polycarbonate and carbon. Japanese Patent Publication No. SHO 63-50470 discloses a flow sheet in which rigidity can be designed in the flow direction (MD) and width (CD) direction by stacking layers of fibers.

Nowadays, flow sheets are manufactured by making prepregs in which carbon fibers are impregnated with resin, and stacking and bonding the prepregs. A prepreg is made into a thin sheet by disposing carbon fibers so that they intersect at right angles, or disposing them in parallel, and impregnating the disposed carbon fibers with resin. Next, a plurality of prepreg sheets are stacked within a mold form, the mold form is put in an autoclave, and within the autoclave the stack of prepreg sheets is heated under high pressure. The heated resin has a fluidity and fills gap between the prepregs. The unnecessary resin is removed from the mold, and the prepregs are bonded and hardened, whereby a flow sheet is molded. Note that before heating, air between the prepregs is removed by suction so that air bubbles do not remain between them.

To prevent fibers and fillers contained in a solution of stock, adhesive matter such as pitch, and adhesive matter due to the propagation of mold from adhering to the surface of a flow sheet, the flow sheet surface is required to be extremely smooth.

Polycarbonate flow sheets for the headbox spread in the 1970s and are still being widely used. Polycarbonate sheets, having a thickness of 1 to 3 mm and not joined in the longitudinal direction, are manufactured by resin makers and are relatively inexpensive and available. The representative tensile strength of the material is about 63 MPa. The arithmetical mean roughness Ra of the material is 0.1 μm or less, so it has excellent smoothness.

The thickness of the extreme end portion of a flow sheet is polished as thin as possible to reduce the eddies of wake flow that occurs on the extreme end portion. Considering strength, the extreme end portion is formed into a tapering shape so that the extreme end is 0.5 mm. In the case of a 3-mm polycarbonate sheet, it is tapered in the range of about 75 to 150 mm upstream from the extreme end.

The upstream end of the flow sheet is fitted in and bonded to a notch formed in a polycarbonate rod. By inserting the rod of the upstream end of the flow sheet into a groove provided in the interior of the headbox, the flow sheet is retained in flow.

Polycarbonate is high in corrosion resistance, but a machined surface is reduced in chemical resistance. Because there are cases where polycarbonate is degraded and cracked even by caustic washing that is performed at a concentration of about 1.5%, it is necessary to remove the flow sheet from the headbox.

To realize the hydraulic functions of the headbox, a technique of positively controlling flow by thickening the shape of a flow sheet was developed in the 1980s. Because of this, flow sheets of vinyl chloride were developed and put to practical use. Because the maximum length of a sheet of vinyl chloride is industrially 2.4 m, vinyl chloride sheets need to be welded and joined together in the longitudinal direction. A vinyl chloride flow sheet, as with a polycarbonate flow sheet, is tapered so that its extreme end is about 0.5 mm. Because vinyl chloride is high in causticity resistance, vinyl chloride flow sheets are not degraded by caustic washing. The smoothness of a machined surface of a vinyl chloride sheet becomes 0.2 to 0.4 μm in terms of arithmetical mean roughness Ra if it is polished. The representative tensile strength of a vinyl chloride sheet is about 55 MPa.

Carbon graphite flow sheets with a tensile strength of 300 to 700 MPa are available and have about five to ten times the strength of polycarbonate or vinyl chloride. Since carbon graphite flow sheets have such a strength characteristic, these flow sheets were developed in the mid-1980s and used partially.

In conventional carbon graphite flow sheets, before stacking, heating, and joining a plurality of sheet prepregs, vacuum suction is performed so that air bubbles do not remain between the prepregs.

In addition, to improve smoothness, carbon sheets are manufactured and then painted, whereby the arithmetical means roughness Ra can be increased up to 0.1 to 0.2 μm.

SUMMARY OF THE INVENTION

In the case of polycarbonate, when the rod of the upstream end is bonded, the strength of the bonded portion is liable to be insufficient. Therefore, when the paper machine is interrupted, the flow sheet of the bonded portion is sometimes damaged. In addition, the taper portion of the extreme end portion needs to be machined and polished. Further, the machined portion of the extreme end portion is degraded by caustic washing and is apt to be cracked.

In the case of vinyl chloride, sheets need to be welded and joined in a longitudinal direction and therefore the strength is reduced.

In the case of conventional carbon graphite flow sheets, products with a smooth surface cannot be made. In removing air bubbles by vacuum suction, the flow of resin is slight and therefore it is difficult to completely remove the air bubbles between prepregs. In addition, since air bubbles remain on the surface of a metal mold, air bubbles on the mold surface must be reduced by inserting a special mat into the gap between the metal mold surface and the flow sheet to remove air bubbles. Because the surface roughness of the mat for removing air bubbles is transferred to products, the flow sheet surface is limited in smoothness. For instance, the arithmetical mean roughness Ra of products made by this manufacturing method is 0.4 to 0.7 μm. Since an autoclave is employed, a large-sized chamber and resin-hardening equipment are required and therefore manufacturing costs are increased.

The method of improving smoothness by painting is able to obtain practical surface roughness, but this method is limited in the bonding strength of a painting and therefore a painting is liable to be separated. Particularly, in fitting a flow sheet in a stainless groove, a painting on that portion will come off.

The present invention has been made in view of the problems described above. Accordingly, it is the object of the present invention to provide a flow sheet for paper machines that has a smooth surface and is easy to handle, and a method of manufacturing such a flow sheet.

To achieve the aforementioned object and in accordance with the present invention, there is provided a manufacturing method of a flow sheet which is used in a paper machine. The manufacturing method of the present invention comprises the steps of: disposing reinforced fibers in a mold to form a reinforced-fiber stack; covering the mold and the reinforced-fiber stack with enclosing members so that an enclosed space is formed inside the enclosing members; supplying matrix resin to the reinforced-fiber stack through one end of the enclosed space to impregnate the reinforced-fiber stack with the matrix resin, while suctioning air from the enclosed space through the other end of the enclosed space; and hardening the matrix resin. This makes it possible to manufacture a flow sheet whose surface is smooth and which is easy to handle.

In addition, if a smoothness of a surface of the mold is 0.25 μm or less in terms of arithmetical mean roughness Ra, a flow sheet for paper machines can be manufactured so that the surface smoothness in a molded state is 0.25 μm or less in terms of arithmetical mean roughness. The molded state indicates the state in which painting and other processes are not performed on the surface, that is, the surface state as reinforced fibers are impregnated with matrix resin.

In addition, in disposing the reinforced fibers, in order for thermal expansion coefficients in thickness, width, and longitudinal directions of the flow sheet to be within a predetermined range, it is preferable to combine and dispose first arrays of the reinforced fibers arranged in parallel in one direction and second arrays of the reinforced fibers arranged so as to intersect at right angles. This can prevent a strain that occurs due to temperature change. It is preferable that the aforementioned thermal expansion coefficients be $6\times10^{-6}$/° C. or more but not exceeding $15\times10^{-6}$/° C.

It is preferable that a strain in the width direction of the one end in the form of the straight line be within 1 mm throughout a longitudinal length of the flow sheet. It is also preferable that the thermal expansion coefficient in the longitudinal direction be between or equal to $8\times10^{-6}$/° C. and $15\times10^{-6}$/° C.

In addition, when disposing the reinforced fibers in the mold to form the reinforced-fiber stack, in a portion of the flow sheet that varies in thickness, a plurality of resin-flow control members may be disposed symmetrically with respect to a center plane of a thickness of the reinforced-fiber stack in the thickness direction, and then the reinforced-fiber stack may be impregnated with the matrix resin.

In the case where the flow sheet has a holder portion formed at one end thereof, a taper portion formed at the other end thereof, and a fluid control portion formed to protrude from a sheet surface between the holder portion and the taper portion, cores may be arranged as resin-flow control member in interior of the fluid control portion so as to extend in the same direction as a direction in which the fluid control portion extends.

In a preferred form, a resin diffusing member is disposed at an end of the reinforced-fiber stack for evenly diffusing and discharging the matrix resin, and the matrix resin is supplied through the resin diffusing member to the reinforced-fiber stack. This makes it possible to evenly impregnate the reinforced-fiber stack with matrix resin.

In another preferred form, the mold comprises two mold forms, and one of the two mold forms is a curl plate having flexibility, which is molded by transferring a shape of a surface of the other of the two mold forms. This makes it possible to easily manufacture the mold and to reliably smooth the surface of the flow sheet.

It is preferable that a bending strength of an extreme end of the taper portion is 40 MPa or more.

It is also preferable that a bend elastic modulus in the width direction be between or equal to 40 GPa and 100 GPa.

The flow-sheet manufacturing method of the present invention is capable of manufacturing a flow sheet whose surface is smooth and which is easy to handle, and this flow sheet is able to reliably rectify the flow of paper stock in the headbox of a paper machine.

BRIEF DESCRIPTION OF THE DRAWINGS

FIG. 3, which includes

FIG. 6, which includes

DETAILED DESCRIPTION OF THE INVENTION

Embodiments of the present invention will hereinafter be described with reference to the drawings.

Figure 1:
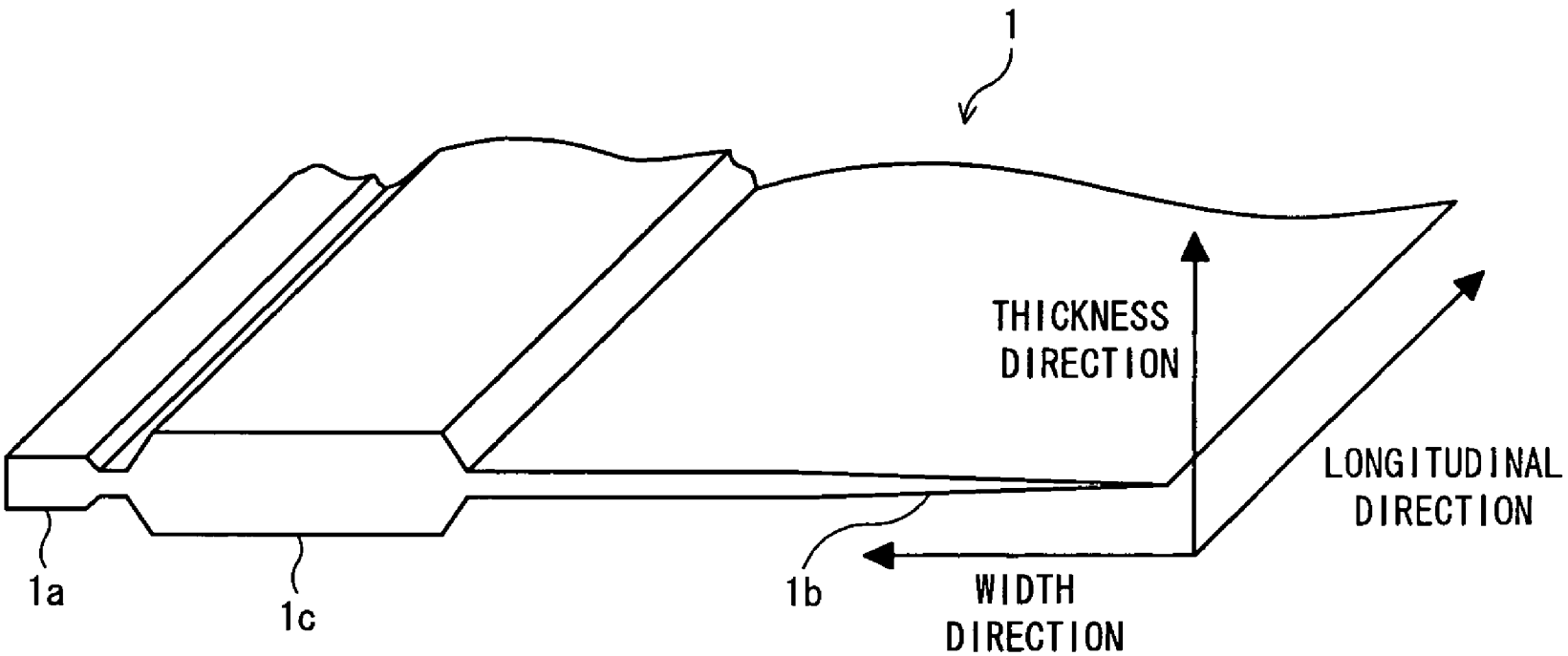
FIG. 1 is a perspective view schematically showing a flow sheet as an embodiment of the present invention.
Figure 2:
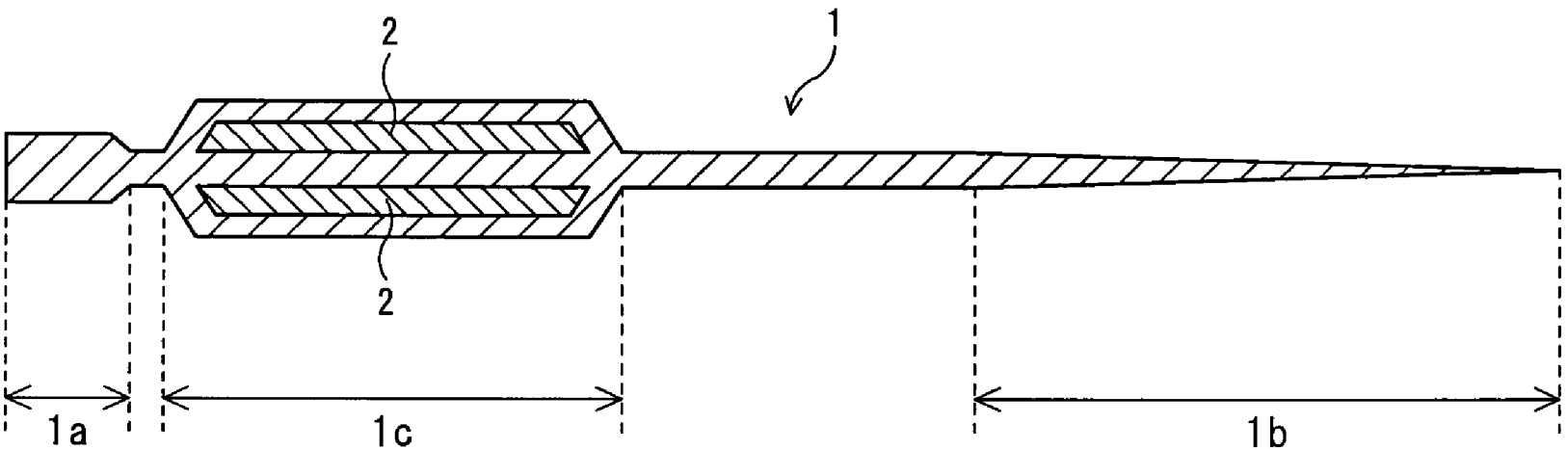
FIG. 2 is a sectional view schematically showing the flow sheet as the embodiment of the present invention.
Figure 3A:
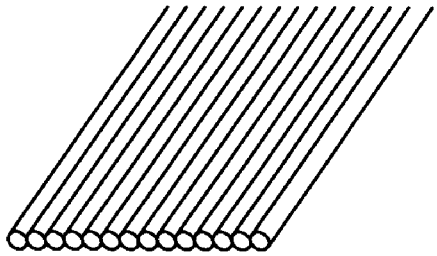
FIGS. 3A and 3B, is a schematic outline diagram for explaining an array of carbon fibers constituting the flow sheet as the embodiment of the present invention.
Figure 3B:
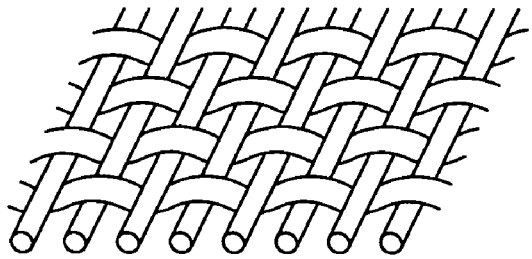
Figure 4:
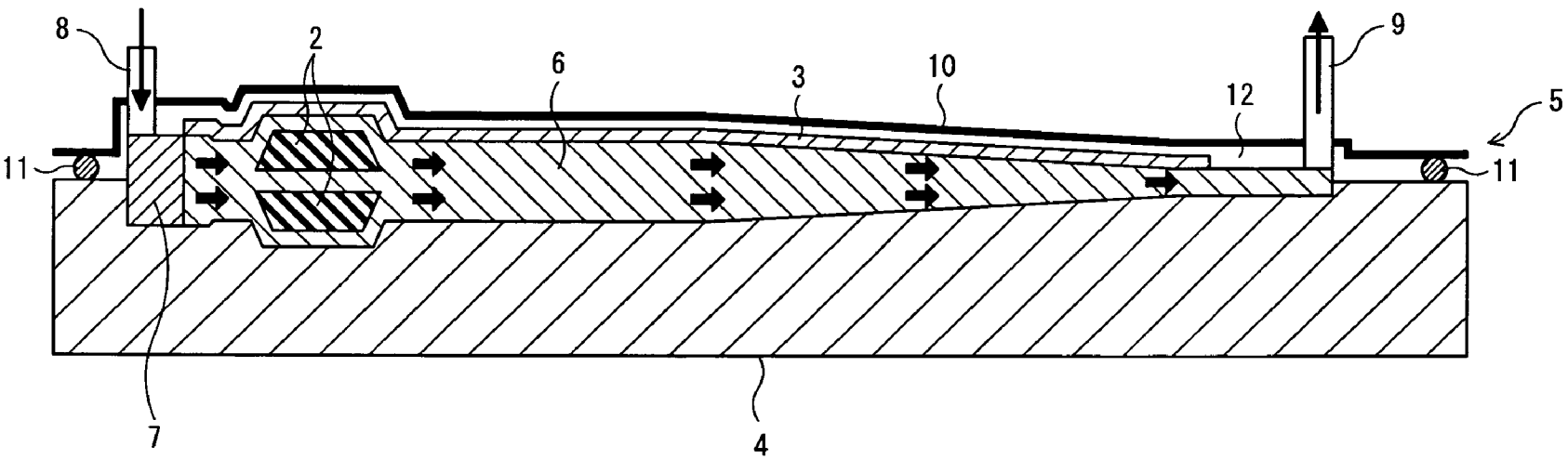
FIG. 4 is a schematic sectional view showing the section of a flow-sheet manufacturing unit as the embodiment of the present invention.
Figure 5:
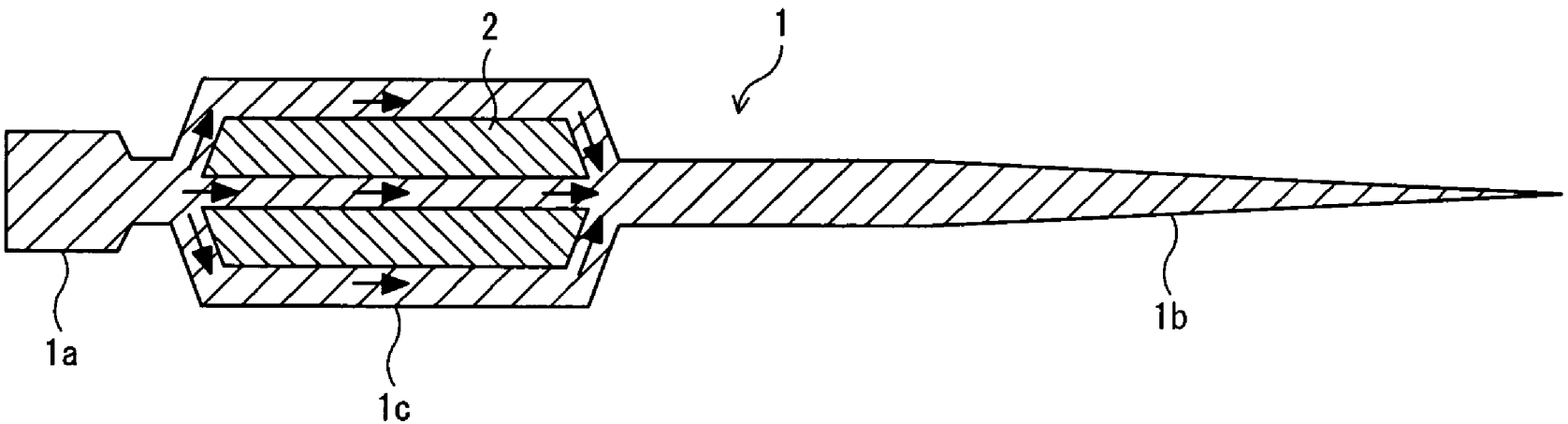
FIG. 5 is a schematic sectional view for explaining the flow of resin in the flow-sheet manufacturing process as the embodiment of the present invention.
Figure 6A:
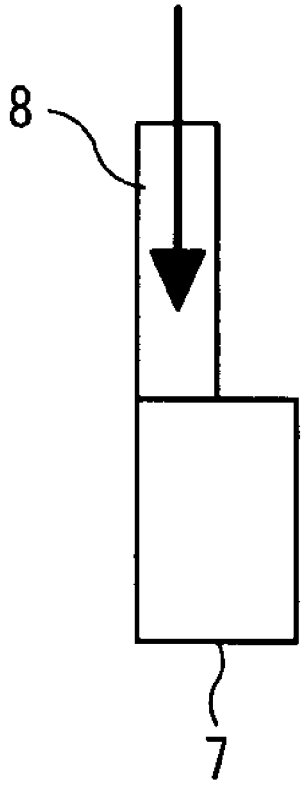
FIGS. 6A and 6B, is an integral-part enlarged diagram schematically showing an integral part of the flow-sheet manufacturing unit as the embodiment of the present invention.
Figure 6B:
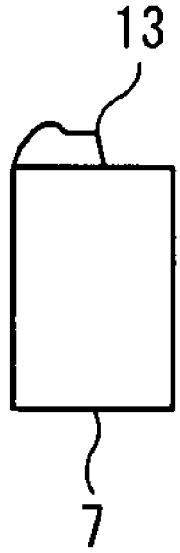
Figure 7:
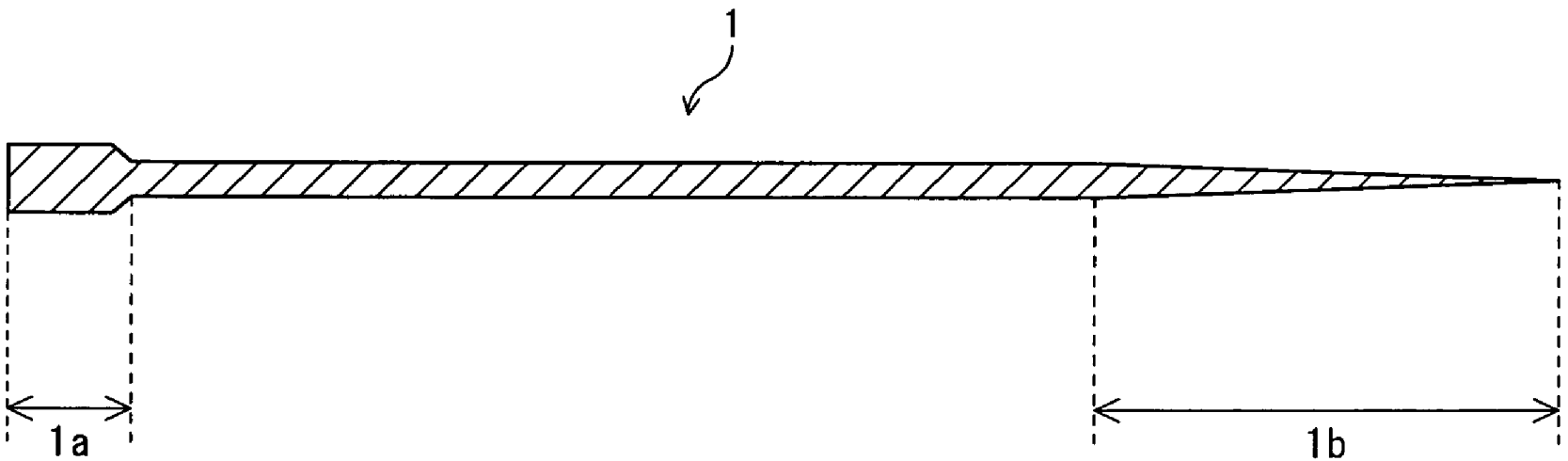
FIG. 7 is a sectional view schematically showing the section of a flow sheet as another embodiment of the present invention.

FIGS. 1 to 6 are used to explain a flow sheet as an embodiment of the present invention. FIG. 1 is a perspective view schematically showing the flow sheet, FIG. 2 is a sectional view schematically showing the section of the flow sheet, and FIG. 3 is a schematic outline diagram for explaining an array of carbon fibers constituting the flow sheet. FIG. 4 is a schematic sectional view showing the section of a flow-sheet manufacturing unit, FIG. 5 is a schematic sectional view for explaining the flow of resin in the flow-sheet manufacturing process, and FIG. 6 is an integral-part enlarged diagram schematically showing an integral part of the flow-sheet manufacturing unit. FIG. 7 is a sectional view schematically showing the section of a flow sheet as another embodiment of the present invention.

Flow Sheet

The flow sheet 1 of this embodiment is molded in carbon fiber reinforced plastic (hereinafter referred to as CFRP when necessary) in which carbon fibers (reinforced fibers) are impregnated with phenol resin (matrix resin). The smoothness of the surface of the flow sheet 1 in the molded state is 0.25 μm or less in terms of arithmetical mean roughness Ra. The flow sheet 1 will hereinafter be described in detail. The molded state used herein indicates the state in which painting and other processes are not performed on the surface, that is, the surface state as reinforced fibers are impregnated with matrix resin.

The flow sheet 1 of this embodiment is molded so as to be rectangular as seen from the direction of the sheet thickness. As shown in FIG. 1, at one end in the width direction, the flow sheet 1 has a holder portion 1*a* extending in the longitudinal direction so that the thickness of the flow sheet 1 increases, and at the other end in the width direction, it also has a taper portion 1*b* extending in the longitudinal direction so that the sheet thickness is gradually reduced toward that end. Between the holder portion 1*a* and the taper portion 1*b*, the flow sheet 1 further has a fluid control portion 1*c* extending in the longitudinal direction so that the sheet thickness increases. The longitudinal direction used in this embodiment means the direction in which the two long sides of the rectangle as seen from the thickness direction extend. The width direction means the direction in which the two short sides of the rectangle extend.

The holder portion 1*a* is formed for holding the flow sheet 1 to a paper machine. For instance, the holder portion 1*a* is formed so that by fitting it in a retaining groove formed in the headbox of the paper machine, the flow sheet 1 can be easily attached to the paper machine.

The taper portion 1*b* is formed for reliably rectifying the flow of paper stock during use. The fluid control portion 1*c* is also formed for rectifying the flow of paper stock by reducing the space in which paper stock causes turbulence during use.

The flow sheet 1, as shown in FIG. 2, is formed symmetrically with respect to the center plane of the sheet thickness, and is formed so that the section of the flow sheet 1 in the plane vertical to the longitudinal direction is the same at all positions.

The flow sheet 1 further has two cores 2 of carbon fiber reinforced plastic (CFRP) interiorly of the fluid control portion 1*c* as resin-flow control members so that they extend in the longitudinal direction. The two cores 2 are spaced from each other so that they are symmetrical with respect to the center plane of the thickness of the flow sheet 1. The two cores 2 are also disposed so that they are separated from the inside surface of the flow sheet 1.

The flow sheet 1 is not particularly limited in size, so it can be formed in various dimensions in accordance with the size of the paper machine used. The thickness of the flow sheet 1 is normally between or equal to 0.5 mm and 10 mm. Preferably, the thickness of the flow sheet 1 is not less than 1 mm and not more than 5 mm. The width-direction length of the flow sheet 1 is normally not less than 200 mm and not more than 1200 mm, and preferably, it is not less than 300 mm and not more than 1000 mm. Normally, the ratio of the thickness and width-direction length of the flow sheet 1 (width-direction length/thickness) is not less than 20 and not more than 600, while the ratio of the width-direction length and the longitudinal-direction length (longitudinal-direction length/width-direction length) is not less than 4 and not more than 30. The thickness of the flow sheet 1 used herein indicates the thickness of the portions other than the holder portion 1*a*, taper portion 1*b*, and fluid control portion 1*c*.

Similarly, the holder portion 1*a* is not particularly limited in size, so it can be formed in various dimensions in accordance with the dimensions of the retaining groove. The width-direction length is normally formed between or equal to 3 mm and 20 mm, while the thickness is formed so as to protrude between or equal to 1.5 mm and 5 mm from the flow sheet 1.

Similarly, the taper portion 1*b* is not particularly limited in size, so it can be formed in various dimensions. Normally, the width-direction length is formed between or equal to 5 mm and 200 mm, and the thickness of the extreme end which is the smallest in thickness is formed between or equal to 0.2 mm and 1 mm. In the case of a flow sheet with a thickness of 1 mm, there are cases where it has no taper portion.

Likewise, the fluid control portion 1*c* is not particularly limited in size, so it can be formed in various dimensions. Normally, the width-direction length is formed between or equal to 20 mm and 200 mm, and the thickness is formed so as to project between or equal to 2 mm and 20 mm from the flow sheet 1.

Next, the carbon fibers within the flow sheet 1 will be described.

Carbon fibers are combined and disposed according to the thickness of the flow sheet 1 as a sheet in which carbon fibers are arranged one by one, or a woven sheet. The gaps between carbon fibers are impregnated with phenol resin.

As shown in FIG. 3A, the above-described sheet in which carbon fibers are arranged has an array (first array) of carbon fibers disposed in parallel in one direction. The carbon fibers are held together by glass fibers (not shown) at regular intervals so that they are not dispersed before being impregnated with phenol resin. Also, the above-described carbon-fiber woven sheet, as shown in FIG. 3B, has an array (second array) of carbon fibers woven so as to intersect at right angles. By combining and stacking the sheets having first and second arrays and impregnating the sheet stack with phenol resin, the flow sheet 1 is molded.

The ratio of carbon fibers and phenol resin is normally between or equal to 15% and 65%, preferably between or equal to 25% and 60%, and further preferably between or equal to 30% and 55%, in terms of a fiber volume content Vf.

The bend elastic modulus in bending the flow sheet 1 in the width direction is normally between or equal to 40 GPa and 100 GPa, preferably between or equal to 50 GPa and 95 GPa, and further preferably between or equal to 65 GPa and 90 GPa.

The extreme end of the taper portion 1*b* of the flow sheet 1 is normally 40 MPa or more, preferably 80 MPa or more, and further preferably 150 MPa or more.

As described above, since the flow sheet 1 has a very smooth surface whose arithmetical mean roughness Ra is 0.25 μm or less in the molded state, the paper stock can be reliably rectified during use and therefore it becomes possible to prevent the flow sheet surface from being stained.

In addition, because the first arrays of carbon fibers and the second arrays of carbon fibers are combined and stacked according to the thickness of the flow sheet 1, by taking advantage that the thermal expansion coefficient of the carbon fiber in the carbon-fiber extending direction is different from that in the direction perpendicular to the carbon-fiber extending direction, the thermal expansion coefficients in the thickness direction, width direction, and longitudinal direction of the flow sheet 1 can be set so as to be within a predetermined range when the flow sheet 1 is molded. Note that the flow sheet 1, in addition to carbon fibers, contains glass fibers used in holding the first array of carbon fibers, but since the ratio of the glass fibers in the flow sheet 1 is normally very small, the influence of the glass fibers is practically negligible. However, taking the influence of the glass fibers into consideration, carbon fibers may be combined. The predetermined range is normally between or equal to $6\times10^{-6}$/° C. and $15\times10^{-6}$/° C., preferably between or equal to $8\times10^{-6}$/° C. and $13\times10^{-6}$/° C., and further preferably between or equal to $10\times10^{-6}$/° C. and $12\times10^{-6}$/° C.

As described above, if the thermal expansion coefficients of the flow sheet 1 are within the predetermined range, it becomes possible to prevent the strain of the flow sheet 1 due to a change in temperature. For example, when the flow sheet 1 is cooled after molding, or when it is installed in the paper machine and used, the temperature of the flow sheet 1 changes, but if this temperature change causes the strain of the flow sheet 1, there is a possibility that the flow sheet 1 cannot be installed in the paper machine or cannot rectify the flow of paper stock. However, if the thermal expansion coefficients of the flow sheet 1 are within the predetermined range, the strain of the flow sheet 1 due to temperature change can be reduced to an allowable range.

Particularly, the holder portion 1*a* and taper portion 1*b* located at the width-direction end portions of the flow sheet 1 have to reliably prevent the occurrence of a strain. More specifically, the holder portion 1*a* is used for holding the flow sheet 1, so if the holder portion 1*a* cannot be fitted in the retaining portion of the paper machine, the flow sheet 1 can no longer be installed in the paper machine. In addition, even if the flow sheet 1 can be held to the paper machine, the strain of the holder portion 1*a* causes a reduction in total accuracy in positioning the flow sheet 1.

In addition, because the taper portion 1*b* plays a vital role in rectifying the flow of paper stock, the strain of the taper portion 1*b* is a direct cause of turbulence in the paper stock flow. However, the holder portion 1*a* and taper portion 1*b* are longer in the longitudinal direction than in the thickness direction and width direction, so they are very liable to strain.

Therefore, it is desirable that the thermal expansion coefficient in the longitudinal direction of the flow sheet 1 be more strictly adjusted so that only a slight strain occur in the entire longitudinal direction of each of the holder portion 1*a* and taper portion 1*b*. Specifically, it is preferable that the strain in the width direction of the straight line of the end portion of the flow sheet 1 as seen from the thickness direction be 1 mm or less over the longitudinal length of the flow sheet 1. For that reason, in this embodiment, the thermal expansion coefficient in the longitudinal direction of the flow sheet 1 is normally between or equal to $6\times10^{-6}$/° C. and $15\times10^{-6}$/° C., preferably between or equal to $8\times10^{-6}$/° C. and $13\times10^{-6}$/° C., and further preferably between or equal to $10\times10^{-6}$/° C. and $12\times10^{-6}$/° C.

In addition, since the flow sheet 1 is formed from CFRP, it is lighter in weight and can obtain higher strength than conventional flow sheets of vinyl chloride. For instance, compared with conventional flow sheets of vinyl chloride, the flow sheet 1 is able to have strength equal to or greater than twice the conventional strength with half the weight. Particularly, there is no fear of inter-layer separation at the extreme end of the taper portion that is liable to break because of its small thickens, and a great advantage of the flow sheet 1 is to have five to ten times strength.

Phenol resin is high in chemical resistance, so even in the case where the paper machine is subjected to caustic washing, it is not necessary to remove the flow sheet 1 from the paper machine, whereby the labor required for maintenance can be reduced.

In addition, by adjusting the ratio of carbon fibers and phenol resin, it is also possible to change the strength, weight, modulus of elasticity, etc., of the flow sheet 1.

Furthermore, matrix resin is not particularly limited in kind, so various kinds of resin other than phenol resin may be used, or two or more kinds of resin may be arbitrarily combined with an arbitrary ratio. For example, from the viewpoint of chemical resistance, it is preferable to employ epoxy resin as matrix resin.

[Flow-Sheet Manufacturing Method]

Next, a manufacturing method of flow-sheet in this embodiment will be described.

First, a manufacturing unit will be described with reference to FIG. 4. A curl plate 3 formed as one mold form is placed over a metal mold 4 formed as another mold form, the curl plate 3 and metal mold 4 constituting a mold 5 for the flow sheet 1. The curl plate 3 and metal mold 4 conform to the external shape of the flow sheet 1 and therefore have depressions corresponding to the holder portion 1*a*, taper portion 1*b*, and fluid control portion 1*c*.

The curl plate 3 is formed from fiber-reinforced plastic (hereinafter referred to as FRP when necessary) and is manufactured by transferring a shape of a surface of the metal mold 4. Accordingly, the curl plate 3 has the same mold shape as that of the metal mold 4. Hence, each of the curl plate 3 and metal mold 4 functions as half mold for manufacturing the flow sheet 1 in the thickness direction. However, the extreme portion on the side of the taper portion 1*b* of the metal mold 4 is formed to extend beyond the overall length of the flow sheet 1 to be manufactured. The extended portion of the metal mold 4 is not covered by the curl plate 3.

The metal mold 4 is formed so that its surface smoothness is 0.25 μm or less in terms of arithmetical mean roughness Ra. Because of this, the smoothness of the surface of the curl plate 3 transferred from the shape of the metal mold 4 is also 0.25 μm or less in terms of arithmetical mean roughness Ra.

The surface of the metal mold 4 is smoothed by a milling or planer and is finished by polishing. Polishing can use polishing paper or a cup grindstone. At the same time, electrolytic polishing may be used. Using these polishing methods, the surface of the metal mold can be relatively economically polished from 0.25 μm up to 0.05 μm in terms of arithmetical mean roughness Ra with existing manufacturing techniques.

The metal mold 4 is constructed such that by controlling the temperature with warm water or oil, a deformation due to thermal expansion during heating can be removed through an elongated hole not shown.

Between the curl plate 3 and the metal mold 4 of the mold 5, as described above, based on the thermal expansion coefficient, bending strength, bend elastic modulus, etc., the first arrays of carbon fibers (reinforced members) and second arrays of carbon fibers (reinforced members) are combined into a carbon-fiber stack 6 as a reinforced-fiber stack. In the interior of the carbon-fiber stack 6 that corresponds to the fluid control portion 1*a*, two cores 2 are disposed as resin-flow control members. The cores 2 extend in the longitudinal direction and are disposed symmetrically with respect to the center plane of the thickness of the flow sheet 1, that is, the joining plane between the curl plate 3 and the metal mold 4. Further, the cores 2 are separated away from the mold 5 by a substantially equal distance and are spaced a predetermined distance apart.

A nonwoven fabric (resin diffusing member) 7 is attached to one end of the carbon-fiber stack 6. The nonwoven fabric 7 is joined with a pipe 8 connected to a tank (not shown) filled with liquid phenol resin. A pipe 9 is attached to the other end of the carbon-fiber stack 6. The pipe 9 is connected to a vacuum pump (not shown).

The top surfaces of the curl plate 3, metal mold 4, nonwoven fabric 7, and pipes 8, 9 are covered with a sheet 10, and the gap between the sheet 10 and the metal mold 4 is sealed by a seal member 11. Only the portions of the sheet 10 that the pipes 8, 9 penetrate are opened and the pipes 8, 9 pass through the opened portions. Therefore, an enclosed space 12 is formed by the sheet 10 and seal member 11 as enclosing member and is connected to the outside by only the pipes 8, 9.

The unit for manufacturing the flow sheet 1 is constructed as described above.

When manufacturing the flow sheet 1 with the manufacturing unit, air is first vacuumed up from the enclosed space 12 through the pipe 9. Using the suction force, phenol resin is supplied to the nonwoven fabric 7 through the pipe 8. Since the pressure within the enclosed space 12 has been reduced, phenol resin is supplied so that it is pushed out to the nonwoven fabric 7 by atmospheric pressure. The supplied phenol resin is evenly discharged from the whole surface of the contact surface between the nonwoven fabric 7 and the carbon-fiber stack 6 toward the carbon-fiber stack 6. The carbon-fiber stack 6 is evenly impregnated with the discharged phenol resin. Note in FIG. 4 that the flow of phenol resin is indicated by arrows.

After the carbon-fiber stack 6 has been completely impregnated with phenol resin, the metal mold 4 is heated so that the interior of the mold 5 rises to approximately 90° C. As a result, the phenol resin that is heat-hardening resin is hardened. Note that the temperature at which heat-hardening resin is hardened can be suitably set according to the kind of heat-hardening resin used and a combination of heat-hardening resin and a hardening agent.

Finally, the nonwoven fabric 7 is removed and the other end portion of the flow sheet 1 not covered with the cover plate 3, that is, the hardened portion corresponding to the extended portion of the metal mold 4 is cut off, whereby the flow sheet 1 is manufactured.

According to the manufacturing method described above, the surface shape of the mold 5, that is, the surface shape of the curl plate 3 and metal mold 4 is transferred to phenol resin, so the smoothness of the surface of the curl plate 3 and metal mold 4 is also transferred. Therefore, the smoothness of the surface of the flow sheet 1 in its molded state is 0.25 μm or less in terms of arithmetical mean roughness Ra.

To control the strength and modulus of elasticity of the flow sheet 1, it is preferable to make the flow sheet 1 by adjusting the fiber volume content Vf. However, in the conventional method of stacking prepregs of CFRP, there is a possibility that carbon fibers will be out of position in bonding prepregs together and therefore strength and modulus of elasticity will not be obtained as designed. In the manufacturing method of this embodiment, however, there is no bonding operation, so it becomes possible to manufacture the flow sheet 1 without carbon fibers being out of position and thus sufficient strength and modulus of elasticity can be obtained. Because there is no bonding of prepregs in the manufacturing method, there is no possibility that the flow sheet 1 will be damaged by separation of prepregs.

There is a possibility that when impregnating with phenol resin, phenol resin will be moved downward by its weight at the portion of the carbon-fiber stack 6 that increases in thickness and will not flow to the end portion in the width direction of the flow sheet 1. In this embodiment, however, since the cores 2 are disposed for controlling the flow of resin, phenol resin is evenly guided horizontally, upwardly, and downwardly, as shown in FIG. 5. Thus, the entire carbon-fiber stack 6 is evenly impregnated with phenol resin.

By suctioning air through the pipe 9, air is removed from the enclosed space 12. Therefore, because air bubbles do not occur as they do in prior art, the carbon-fiber stack 6 is reliably impregnated with phenol resin.

Note that the curl plate 3 formed from FRP has flexibility. Therefore, in impregnating with phenol resin, the curl plate 3 can closely contact so that the gap between the carbon-fiber stack 6, phenol resin and the mold 5 (i.e., the gap between the curl plate 3 and the metal mold 4) is filled up. This makes it possible to transfer the shape of the surface of the mold 5 to the flow sheet 1 reliably.

The nonwoven fabric 7, in addition to the effect of evenly supplying phenol resin to the carbon-fiber stack 6, has the effect of preventing an excess of phenol resin from remaining in hardening the phenol resin. That is to say, if the pipe 8 is coupled directly to the carbon-fiber stack 6, phenol resin which not being impregnated the carbon-fiber stack 6 with at the coupled portion and remaining within the pipe 8 will be hardened. Because of this, it becomes necessary to mechanically remove the hardened phenol resin afterward. However, as shown in FIG. 6A, if phenol resin is supplied from the pipe 8 to the nonwoven fabric 7, phenol resin 13 remaining within the pipe 8 will be hardened on the surface of the nonwoven fabric 7, as shown in FIG. 6B. Therefore, when removing the nonwoven fabric 7, the hardened phenol resin can be removed at the same time, whereby manufacture becomes simpler.

According to the manufacturing method of this embodiment, the surface of the flow sheet 1 need not to be polished or painted in order to improve the surface smoothness, as done in prior art. In addition, the flow sheet 1 does not need to be pressurized by an autoclave, etc. Thus, the flow sheet can be manufactured in a shorter time and with simpler equipment, compared with prior art. For instance, even a larger flow sheet than a conventional one which is 9 m in longitudinal length can be manufactured in a short time.

While the present invention has been described with reference to the preferred embodiment thereof, the invention is not to be limited to the details given herein, but may be modified within the scope of the invention hereinafter claimed.

For example, although the flow sheet 1 is rectangular as seen from the thickness direction, it may be formed into an arbitrary shape. Even when the flow sheet 1 is formed into a rectangular shape, the holder portion 1*a*, taper portion 1*b*, and fluid control portion 1*c* may be formed to extend in directions other than the longitudinal direction.

The flow sheet 1 may include a deformable portion other than the holder portion 1*a*, taper portion 1*b*, and fluid control portion 1*c*. Conversely, the flow sheet 1 may not include any or all of the holder portion 1*a*, taper portion 1*b*, and fluid control portion 1*c*. For instance, as shown in FIG. 7, a flow sheet may be manufactured without forming the fluid control portion 1*c*.

In addition to the flat flow sheet 1, it is possible to manufacture a curved flow sheet.

The flow sheet 1 may contain components other than reinforced fibers and matrix resin. For instance, if the flow sheet 1 contains a pigment near the surface, it can be recognized individually by eye, and it is possible to draw a design on the flow sheet 1 by adjusting the position and type of pigment used. However, in the case where the flow sheet 1 contains components other than reinforced fibers and matrix resin, attention must be paid on weight, type, and arrangement so that the smoothness of the surface is not impaired or an unallowable warp does not develop in the flow sheet 1.

The reinforced fibers are not limited to carbon fibers, but may employ various kinds of fibers or may employ a combination of a plurality kinds of fibers. A fiber volume content and arrangement may be the same as the case of carbon fibers, but it is preferable that they be adjusted according to the kind of reinforced fibers used. Examples of the reinforced fibers are inorganic fibers such as glass fibers and boron fibers, and organic fibers such as aramid fibers and polyamide fibers. The flow sheet 1 may use an array of fibers other than the first and second arrays. For example, reinforced fibers can be disposed in nonwoven fabric's form lacking determined directions.

As described above, matrix resin is not limited to phenol resin, but may employ various kinds of resin or may employ a combination of a plurality kinds of resin. However, it is preferable that matrix resin be heat-hardening resin. The temperature at which heat-hardening resin is hardened can be suitably set according to the kind of heat-hardening resin used and a combination of heat-hardening resin and a hardening agent. However, it is preferable that heat-hardening resin be hardened at a temperature of 120° C. or less.

Examples of matrix resin are epoxy resin, unsaturated polyester resin, vinyl ester resin and so on. Among them, from the viewpoint of chemical resistance, it is preferable to employ epoxy resin as matrix resin.

The position at which the cores 2 as resin-flow control member are disposed within the flow sheet 1 is not limited to the fluid control portion, but may be installed in any other portion. The material of the core 2 is not limited to CFRP, but it can be formed from various materials.

The material and manufacturing method of the curl plate 3 are not limited to CFRP and transfer, but it may be manufactured from other materials by other methods. However, it is preferable that the material of the curl plate 3 have flexibility.

What is claimed is:

1. A flow sheet provided in a headbox of a paper machine for rectifying a flow of paper stock within the headbox, said flow sheet comprising:

reinforced fibers impregnated with matrix resin and molded;

a surface smoothness in a molded state that is 0.25 μm or less in terms of arithmetical mean roughness Ra;

a holder portion formed at a first end of said flow sheet;

a taper portion formed at a second end of said flow sheet;

a fluid control portion having an interior and formed to protrude from a sheet surface between said holder portion and said taper portion; and cores arranged in the interior of said fluid control portion, while extending in the same direction as a direction in which said fluid control portion extends.

2. The flow sheet as set forth in claim 1, wherein first arrays of said reinforced fibers arranged in parallel in one direction and second arrays of said reinforced fibers arranged so as to intersect at right angles are combined and stacked according to a thickness of said flow sheet; and thermal expansion coefficients in thickness, width, and longitudinal directions of said flow sheet are within a predetermined range.

3. The flow sheet as set forth in claim 2, wherein the thermal expansion coefficients in the thickness, width, and longitudinal directions are between or equal to $6\times10^{-6}$/° C. and $15\times10^{-6}$/° C.

4. The flow sheet as set forth in claim 2, wherein at least one end in the width direction is formed in a straight line, and a strain in the width direction of said one end in the form of said straight line is within 1 mm throughout a longitudinal length thereof.

5. The flow sheet as set forth in claim 4, wherein the thermal expansion coefficient in the longitudinal direction is between or equal to $8\times10^{-6}$/° C. and $15\times10^{-6}$/° C.

6. The flow sheet as set forth in claim 1, further including a taper portion, and a bending strength of an extreme end of said taper portion is 40 MPa or more.

7. The flow sheet as set forth in claim 1, wherein a bend elastic modulus in the width direction is between or equal to 40 GPa and 100 GPa.

8. A manufacturing method of a flow sheet which is used in a paper machine, comprising:

disposing reinforced fibers in a mold to form a reinforced-fiber stack;

covering said mold and said reinforced-fiber stack with enclosing members so that an enclosed space is formed inside said enclosing members;

supplying matrix resin to said reinforced-fiber stack through one end of said enclosed space to impregnate said reinforced-fiber stack with said matrix resin, while suctioning air from said enclosed space through the other end of said enclosed space; and hardening said matrix resin.

9. The manufacturing method as set forth in claim 8, wherein a smoothness of a surface of said mold is 0.25 μm or less in terms of arithmetical mean roughness Ra.

10. The manufacturing method as set forth in claim 8, wherein first arrays of said reinforced fibers arranged in parallel in one direction and second arrays of said reinforced fibers arranged so as to intersect at right angles are combined and stacked so that thermal expansion coefficients in thickness, width, and longitudinal directions are within a predetermined range.

11. The manufacturing method as set forth in claim 8, wherein, when disposing said reinforced fibers in said mold to form said reinforced-fiber stack, in a portion of said flow sheet that varies in thickness, a plurality of resin-flow control members are disposed symmetrically with respect to a center plane of a thickness of said reinforced-fiber stack in the thickness direction, and then said reinforced-fiber stack is impregnated with said matrix resin.

12. The manufacturing method as set forth in claim 8, wherein a resin diffusing member is disposed at an end of said reinforced-fiber stack for evenly diffusing and discharging said matrix resin; and said matrix resin is supplied through said resin diffusing member to said reinforced-fiber stack.

13. The manufacturing method as set forth in claim 8, wherein said mold comprises two mold forms; and one of said two mold forms is a curl plate having flexibility, which is molded by transferring a shape of a surface of the other of said two mold forms.

* * * * *